US010120313B2

(12) United States Patent
Sugiyama

(10) Patent No.: US 10,120,313 B2
(45) Date of Patent: Nov. 6, 2018

(54) IMAGE FORMING APPARATUS FOR EXECUTING POST PROCESSING AND PROCESSING METHOD

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Hiroyuki Sugiyama, Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/878,517

(22) Filed: Jan. 24, 2018

(65) Prior Publication Data

US 2018/0150009 A1 May 31, 2018

Related U.S. Application Data

(63) Continuation of application No. 15/333,237, filed on Oct. 25, 2016, now Pat. No. 9,910,393.

(51) Int. Cl.
*G03G 15/00* (2006.01)

(52) U.S. Cl.
CPC ..... *G03G 15/50* (2013.01); *G03G 15/6585* (2013.01)

(58) Field of Classification Search
CPC ..... G03G 15/50; G03G 15/6585
See application file for complete search history.

(56) References Cited

U.S. PATENT DOCUMENTS

| | | | |
|---|---|---|---|
| 9,104,154 | B2 | 8/2015 | Fujiwara |
| 9,527,329 | B1 | 12/2016 | Takeishi |
| 2011/0310422 | A1 | 12/2011 | Hagiwara |
| 2016/0103644 | A1 | 4/2016 | Saito et al. |
| 2016/0229164 | A1 | 8/2016 | Taki |

OTHER PUBLICATIONS

Non-Final Office Action for U.S. Appl. No. 15/333,237 dated Jul. 12, 2017.
Non-Final Office Action for U.S. Appl. No. 15/653,654 dated Aug. 31, 2017.

*Primary Examiner* — Sophia S Chen
(74) *Attorney, Agent, or Firm* — Amin, Turocy & Watson LLP

(57) ABSTRACT

An image forming apparatus includes a first image forming section which uses a color material for non-removal to form an image on an image receiving medium, a second image forming section which uses a color material for removal to form an image on an image receiving medium, a first processing section for making a hole in the image receiving medium, a second processing section which does not make a hole in the image receiving medium, and a controller which executes the second processing without executing the first processing to the image receiving medium on which the image is formed with the color material for removal at the time of executing a job if the job contains formation of the image with the color material for removal and carries out the first processing.

15 Claims, 8 Drawing Sheets

IMAGE FORMING APPARATUS FOR EXECUTING POST PROCESSING AND PROCESSING METHOD

CROSS-REFERENCE TO RELATED APPLICATION

This application is a Continuation of application Ser. No. 15/333,237 filed Oct. 25, 2016, the entire contents of which are incorporated herein by reference.

FIELD

Embodiments described herein relate generally to a post processing technology according to a processing of an image receiving medium.

BACKGROUND

Conventionally, there is an image forming apparatus that can carry out any one of a non-decoloring printing using a color material for non-removal (permanent printing) and a decoloring printing using a decolorable color material. Through heating an image receiving medium to which the decoloring printing is carried out, an image can be decolored, and the image receiving medium can be reused.

There is an image forming apparatus that can execute a stapling processing. It is necessary to pull out a staple from the image receiving medium before the decoloring processing of the image receiving medium so as to reuse the image receiving medium to which the image forming apparatus carries out the stapling processing at the time of the decoloring printing. However, if the staple is pulled out from the image receiving medium, there is a problem that holes are left on the image receiving medium.

DETAILED DESCRIPTION

Figure 1:
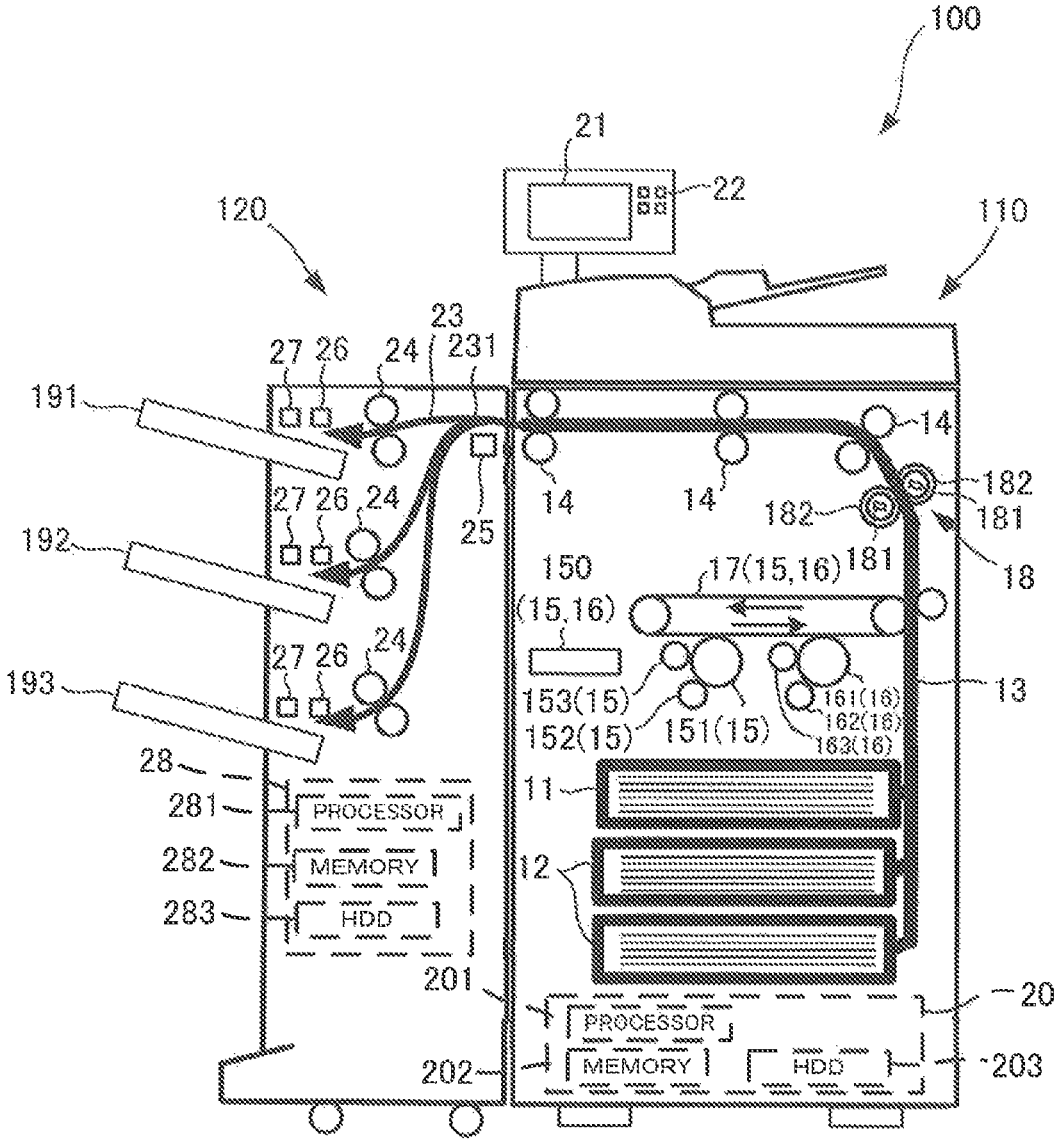
FIG. 1 is a diagram illustrating the configuration of an image forming apparatus 100.

Generally, in accordance with an embodiment, an image forming apparatus comprises a first image forming section, a second image forming section, a first processing section, a second processing section and a controller. The first image forming section uses a color material for non-removal to permanently form an image on an image receiving medium. The second image forming section uses a color material for removal to temporarily form an image on an image receiving medium. The first processing section carries out a first processing for making a hole in the image receiving medium on which the first image forming section or the second image forming section forms an image. The second processing section carries out a second processing which does not make a hole in the image receiving medium on which the first image forming section or the second image forming section forms an image. The controller carries out the second processing without carrying out the first processing to the image receiving medium on which the image is formed with the color material for removal at the time of executing a job in a case in which the job contains formation of the image with the color material for removal and carries out the first processing.

Generally, in accordance with another embodiment, a method for executing a job is carried out by an image forming apparatus that can carry out formation of an image on an image receiving medium using a color material for non-removal and formation of an image on an image receiving medium using a color material for removal, and also can carry out a first processing for making a hole and a second processing that does not make a hole in the image receiving medium on which the image is formed. The method involves executing the second processing without carrying out the first processing to the image receiving medium on which the image is formed with the color material for removal at the time of executing the job in a case in which the job contains formation of the image with the color material for removal and carries out the first processing.

Generally, in accordance with an embodiment, a processing apparatus of a job carries out a processing to an image receiving medium on which an image forming apparatus that can carry out formation of an image on an image receiving medium using a color material for non-removal and formation of an image on an image receiving medium using a color material for removal forms an image. The processing apparatus comprises a first processing section, a second processing section and a controller. The first processing section carries out a first processing for making a hole in the image receiving medium to the image receiving medium on which the image forming apparatus forms an image. The second processing section carries out a second processing which does not make a hole in the image receiving medium to the image receiving medium on which the image forming apparatus forms an image. The controller carries out the second processing without carrying out the first processing to the image receiving medium on which the image forming apparatus forms an image at the time of executing a job by the image forming apparatus and the processing apparatus in a case in which the job executed by the image forming apparatus contains formation of the image with the color material for removal and carries out the first processing.

Hereinafter, embodiments are described with reference to the accompanying drawings.

First Embodiment

FIG. 1 is a diagram illustrating the configuration of an image forming apparatus 100.

The image forming apparatus 100 is equipped with an apparatus main body 110 and a finisher 120 (processing apparatus such as a post processing apparatus).

The apparatus main body 110 can execute a print job for non-removal, a print job for removal and a removal job.

The print job for non-removal refers to a job of permanently forming an image on an image receiving medium with a color material for non-removal. In the present embodiment, as toner is used as the color material for non-removal, the print job for non-removal contains a fixing processing for fixing the image on the image receiving medium by heating the image receiving medium in addition to a printing processing.

The print job for removal refers to a job of forming an image on an image receiving medium with color material for removal. In the present embodiment, as toner is used as the color material for removal, the print job for removal contains a fixing processing for fixing the image on the image receiving medium by heating the image receiving medium in addition to a printing processing.

The removal job refers to a job of removing the image on the image receiving medium which is formed with the color material for removal. In the present embodiment, in the removal job, through heating the image receiving medium with a heat source 18, the image on the image receiving medium is decolored. The removal job may be a job of decoloring the image on the image receiving medium through heating the image receiving medium, irradiating the image receiving medium with light, or a job of removing the color material on the image receiving medium from the image receiving medium through a blade or some other physical contact or chemical means.

The color material for removing is, for example, a decoloring toner, and contains a coloring compound, developer and a decoloring agent in addition to resin. For example, a leuco dye which develops blue is exemplified as the coloring compound. For example, a phenol type is exemplified as the developer. A matter that is miscible with the coloring compound if heated and has no affinity for the developer is exemplified as the decoloring agent. The decolorable color material develops color through the interaction between the coloring compound and the developer and is decolored as the interaction between the coloring compound and the developer is cut off through the heating at a temperature equal to or greater than a decoloring temperature. The color material for removal may be ink that is decolored through being heated or irradiated with the light. The color material for removing may be toner or ink suitable to be removed through a blade from the image receiving medium.

The decoloring (removal of an image) refers to making an image formed with a color (containing not only chromatic colors but also achromatic colors such as white, black and the like) different from a base color of the image receiving material invisible visually or difficult to be visually seen. The invisible visually refers to making the image formed with the color different from the base color of the image receiving material change to a color identical or similar to the base color of the image receiving material in addition to a form in which the image formed with the color different from the base color of the image receiving material is colorless (transparent).

The color material for non-removal is an ordinary color material not for the purpose of removing, and is, for example, a toner not including the developer and the decoloring agent. The color material for non-removing contains carbon as the color developing agent in addition to the resin.

The apparatus main body 110 can also execute a copy job. The apparatus main body 110 uses document data read as image data to generate the copy job. The copy job is also executed by using the color material for non-removing and the color material for removing. Hereinafter, the print job for non-removal can also be referred to as a copy job for non-removal for forming the image on the image receiving medium with the color material for non-removal. The print job for removal can also be referred to as a copy job for removal for forming the image on the image receiving medium with the color material for removal.

The image receiving medium is a paper, an envelope, a transparency and the like.

The apparatus main body 110 is equipped with paper feed cassettes 11 and 12, a conveyance path 13, a conveyance roller 14, a first image forming section 15, a second image forming section 16, a heat source 18, a controller 20, a display 21 and an operation section 22.

The paper feed cassette 11 stacks the image receiving media used in the print job for non-removal and the print job for removing.

The paper feed cassette 12 stacks the image receiving media, used in the removal job, on which an image is formed with the color material for removal.

The conveyance path 13 is a path of the image receiving medium from the paper feed cassettes 11 and 12 to the finisher 120 and guides the image receiving medium towards the downstream side.

The conveyance roller 14 is positioned at a proper position in the conveyance path 13 to send the image receiving medium to the downstream side.

The first image forming section 15 forms an image on the image receiving medium with the color material for non-removal. The first image forming section 15 forms an image only with the color material for non-removal entirely in black; however, the first image forming section 15 may also form the image with the color material for non-removal of a plurality of colors. The first image forming section 15 has components required for image formation such as an exposure section 150, a first photoconductor 151, a charging charger 152, a developing device 153 and the like. The charging charger 152 charges the first photoconductor 151. The exposure section 150 exposes the first photoconductor 151 through the laser to form an electrostatic latent image on the first photoconductor 151. The developing device 153 develops the electrostatic latent image on the first photoconductor 151 with the color material for non-removal to form a toner image on the first photoconductor 151. The first photoconductor 151 transfers the toner image onto a transfer belt 17. The transfer belt 17 transfers the toner image onto the image receiving medium.

The second image forming section 16 has components required for image formation such as an exposure section 150, a second photoconductor 161, a charging charger 162, a developing device 163 and the like. The charging charger 162 charges the second photoconductor 161. The exposure section 150 exposes the second photoconductor 161 through the laser to form an electrostatic latent image on the second photoconductor 161. The developing device 163 develops the electrostatic latent image on the second photoconductor 161 with the color material for removal to form a toner image on the second photoconductor 161. The second photoconductor 161 transfers the toner image onto the transfer belt 17. The transfer belt 17 transfers the toner image onto the image receiving medium.

The first image forming section 15 and the second image forming section 16 may form images independently. The second image forming section 16 may overlay an image formed with the color material for removing on the image formed with the color material for non-removal by the first image forming section 15 to form one image.

The first image forming section 15 forms the image only with the color material for non-removal in black color; however, the first image forming section 15 may also form the image by using the color material for non-removal in a plurality of colors. The second image forming section 16 forms the image only with the color material for removal in blue color; however, the second image forming section 16 may also form the image by using the color material for removing in a plurality of colors. The exposure section 150 and the transfer belt 17 serve as components of the second image forming section 16 and the first image forming section 15. The second photoconductor 161 is positioned at the downstream side (transfer position side at an end point) of the first photoconductor 151 if the position where the image is transferred from the transfer belt 17 onto the image receiving medium is taken as the end point in the rotation direction of the transfer belt 17. The second photoconductor 161 may be positioned at the upstream side of the first photoconductor 151.

The heat source 18 is equipped with a heater 181 and a heat roller 182.

The heater 181 is positioned in the heat roller 182 and heats the heat roller 182.

A pair of the heat rollers 182 contacts with each surface of the image receiving medium. The heat roller 182 includes a function of heating the image receiving medium on which the first and the second image forming sections 15 and 16 form images to fix the images on the image receiving medium and a function of heating the image receiving medium on which an image is formed with the color material for removing to decolor the image.

The controller 20 is equipped with a processor 201, a memory 202 and an HDD 203 (Hard Disk Drive), and controls the whole of the image forming apparatus 100. The controller 20 controls the finisher 120 via a controller 28 of the finisher 120 with respect to the finisher 120. The processor 201 executes programs stored in the memory 202 and the HDD 203 to realize various functions of the image forming apparatus 100.

The display 21 displays setting information and an operation status of the image forming apparatus 100, log information and notification to a user.

The operation section 22 includes buttons and keys to receive an input by the user.

The finisher 120 carries out the post processing to the image receiving medium on which the apparatus main body 110 forms the image. The finisher 120 is equipped with paper discharge trays 191~193, a conveyance path 23, a conveyance roller 24, a puncher 25 (first processing section), a stapler 26 (first processing section), a no damage binding (NDB) unit 27 (second processing section), and the controller 28.

The conveyance path 23 is a path of the image receiving medium from the apparatus main body 110 to the paper discharge trays 191~193, and guides the image receiving medium towards the downstream side.

The conveyance roller 24 is positioned at a proper position of the conveyance path 23, and guides the image receiving medium towards the downstream side.

The finisher 120 discharges the image receiving medium on which the image is formed with the color material for non-removal to the paper discharge tray 191. The finisher 120 discharges the image receiving medium on which the image is formed with the color material for removal to the paper discharge tray 192. The finisher 120 discharges the image receiving medium to which the removing processing is carried out to the paper discharge tray 193.

In the conveyance path 23, a bifurcation 231 is arranged at a position from the apparatus main body 110 towards the downstream. The conveyance path 23 bifurcated by the bifurcation 231 reaches each of the paper discharge trays 191~193. A puncher 25 is arranged at the upstream side of the bifurcation 231.

The puncher 25 makes holes in the image receiving medium. A ring passes through each hole of the bundle of the image receiving media on which the puncher 25 makes holes, and thus, the image receiving medium bundle can be bound.

Figure 2:
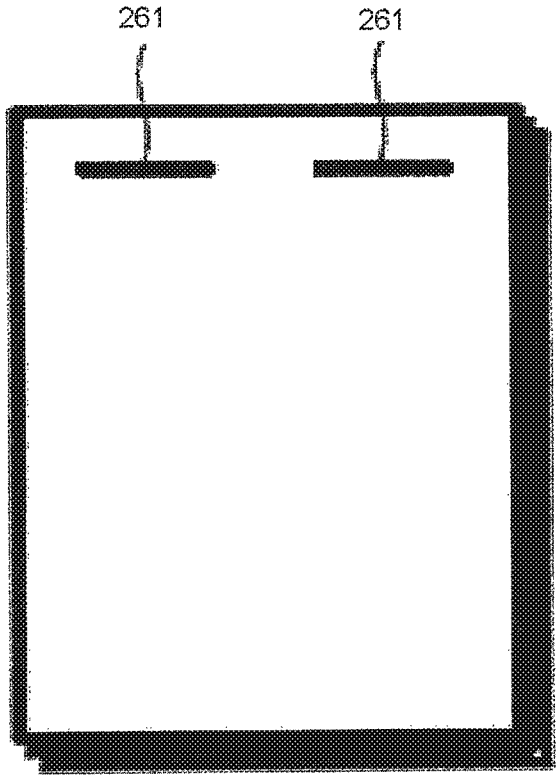
FIG. 2 is a diagram illustrating an image receiving medium bundle bound by staples 261.
Figure 3:
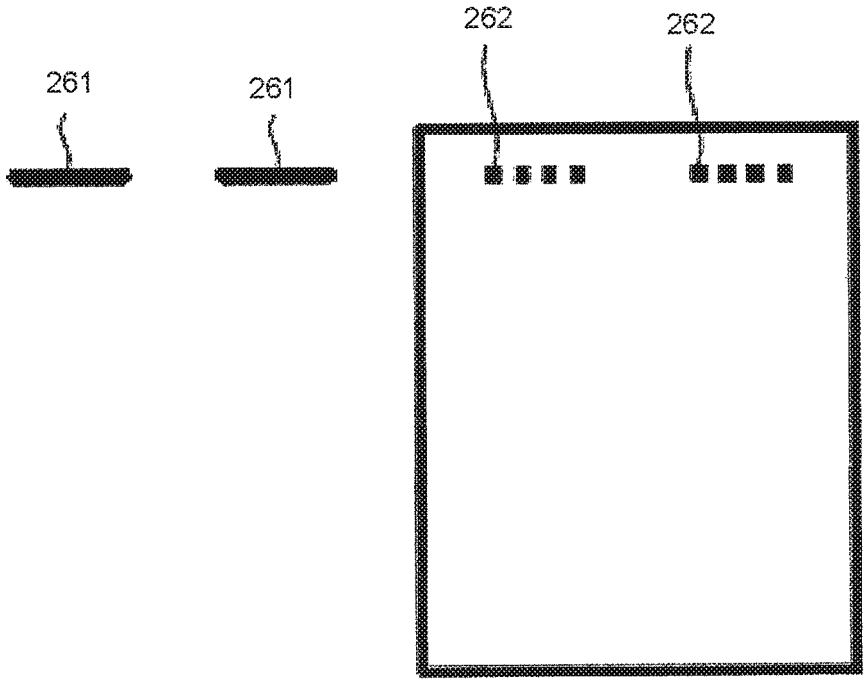
FIG. 3 is a diagram illustrating an image receiving medium bundle from which the staples 261 are detached.

The stapler 26 is arranged corresponding to the paper discharge trays 191~193. The stapler 26 drives the staple 261 into the image receiving medium bundle to bind the image receiving medium bundle as shown in FIG. 2. At the time of reusing the image receiving medium bundle on which the image is formed with the color material for removing and to which the stapling processing is carried out, as shown in FIG. 3, it is necessary to pull out the staple 261 from the image receiving medium bundle. If the staple 261 is pulled out form the image receiving medium bundle, holes 262 caused by the staple 261 are left on the image receiving medium, and the image receiving medium becomes an unfavorable state for reuse.

The first processing section carries out the first processing for making a hole on the image receiving medium to the image receiving medium on which the first and the second image forming sections 15 and 16 form the image. Making a hole involves formation of a notch. The puncher 25 and the stapler 26 are the first processing sections.

Figure 4:
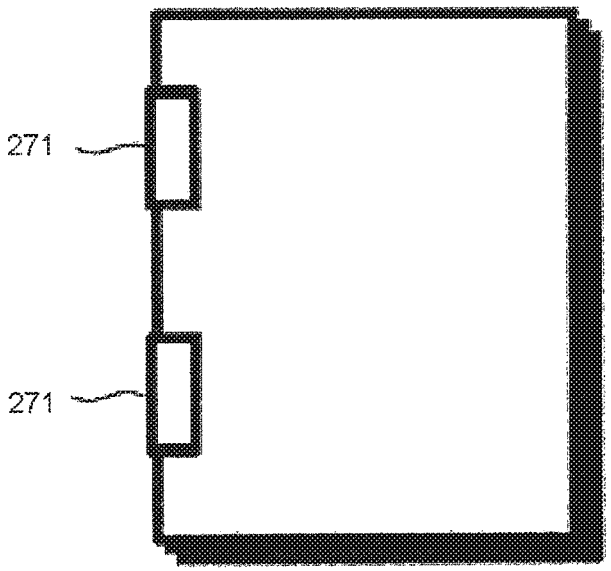
FIG. 4 is a diagram illustrating an image receiving medium bundle bound by clips.

The NDB unit 27 carries out an NDB (No Damage Binding) processing for binding the image receiving medium bundle without making a hole in the image receiving medium bundle. As shown in FIG. 4, the NDB unit 27 gradually shifts one edge of a transverse direction of each image receiving medium to the inner side to be positioned at the lower side. The NDB unit 27 mounts a detachable U-shape clip 271 at one edge of the transverse direction of the image receiving medium bundle. The adhesive is coated on the inner surface of the clip 271.

Figure 5:
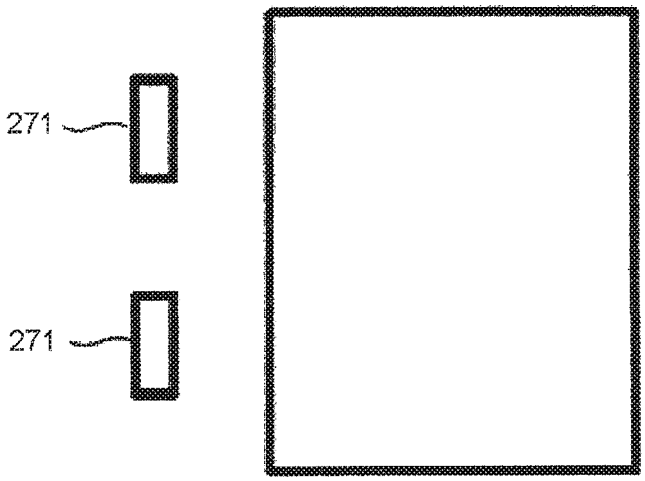
FIG. 5 is a diagram illustrating an image receiving medium bundle from which the clips are detached.

The clip 271 contacts with one edges of all the image receiving media of the image receiving medium bundle to bind the image receiving medium bundle. As the clip 271 only adheres to the image receiving medium, even if the clip 271 is detached from the image receiving medium, the hole is not made on the image receiving medium. Thus, as shown in FIG. 5, if the clip 271 is detached from the image receiving medium, the image receiving medium can be reused.

The second processing section carries out the second processing that does not make a hole in the image receiving medium to the image receiving medium on which the second image forming section 16 forms the image. The NDB unit 27 is the second processing section.

The controller 28 is equipped with a processor 281, a memory 282 and an HDD 283, and controls the finisher 120 under the control of the apparatus main body 110. The processor 281 executes programs stored in the memory 282 and the HDD 283 to realize various functions of the finisher 120.

The controller 20 of the apparatus main body 110 receives setting/non-setting of an automatic NDB via the operation section 22. In a case in which the automatic NDB is set, the controller 20 carries out the following processing in a case in which a job contains formation (print or copy) of the image using the color material for removal and carries out the first processing for making a hole in the image receiving medium. The controller 20 carries out the second processing that does not make a hole in the image receiving medium without carrying out the first processing to the image receiving medium on which the second image forming section 16 forms the image at the time of executing the job.

The controller 20 carries out the first processing without any changes in a case in which the automatic NDB is not set even if the job contains formation of the image using the color material for removal and carries out the first processing for making a hole in the image receiving medium.

Figure 6:
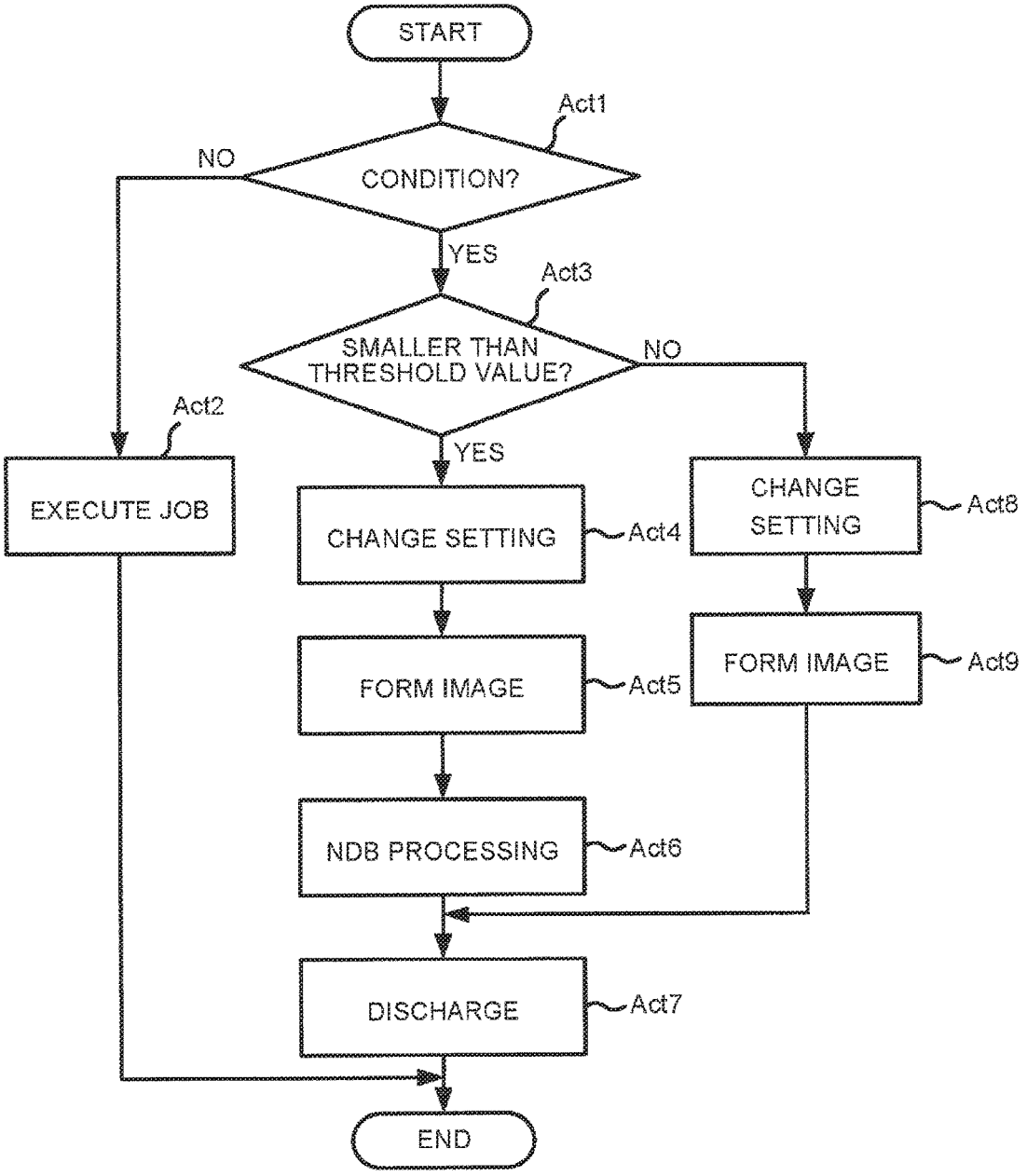
FIG. 6 is a flowchart illustrating a processing of a job by a controller 20.
Figure 7:
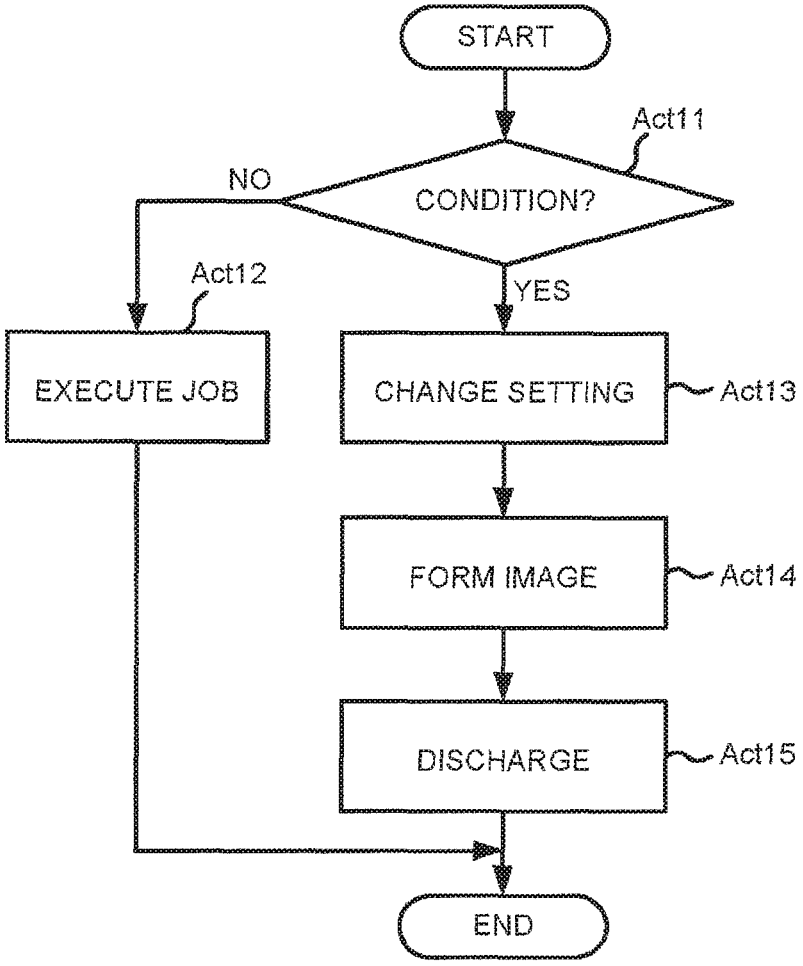
FIG. 7 is a flowchart illustrating a processing of a job by the controller 20.
Figure 8:
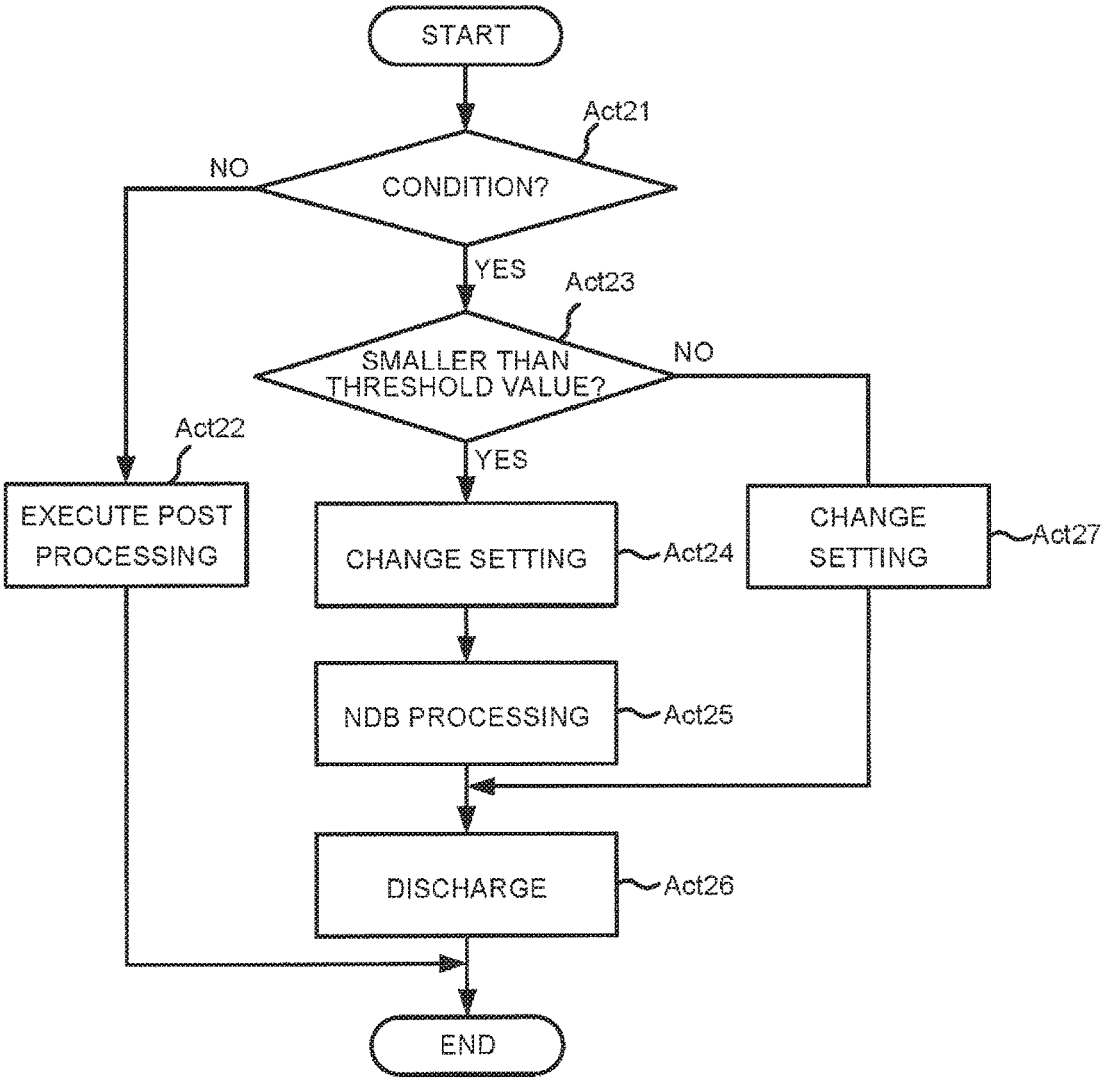
FIG. 8 is a flowchart illustrating a processing by a finisher.

Hereinafter, a specific processing of the job by the controller 20 is described with reference to FIG. 6. Hereinafter, the job executed by the controller 20 is a print job for removing. In FIG. 6 and FIGS. 7 and 8 described later, the apparatus main body 110 and the finisher 120 execute each processing through executing the programs stored in the memories 202 and 282 by the processors 201 and 281.

If the print job for removing does not meet conditions (No in Act 1), the controller 20 executes the job without changing the setting of the print job for removal (Act 2). The conditions refer to that the automatic NDB is set and that the stapling processing is set as the post processing of the print job for removing. The controller 20 refers to the conditions stored in the memory 202 to determine whether or not the print job for removing meets the conditions (Act 1).

Thus, the controller 20 carries out the stapling processing if the automatic NDB is not set and if the stapling processing is set in the print job for removal.

If the print job for removing meets the conditions (Yes in Act 1) and the number of processed sheets of the job is smaller than a threshold value (Yes in Act 3), the controller 20 carries out the following processing. The controller 20 switches the stapling processing (first processing) to an NDB processing (second processing) in the setting of the post processing of the print job for removing (Act 4).

The controller 20 executes the job (Acts 5~7). More specifically, the controller 20 sends the image receiving medium to the finisher 120 after the image is formed on the image receiving medium with the color material for removing by the second image forming section 16. The controller 20 carries out the processing corresponding to the number of the processed sheets of the job (Act 5).

The controller 20 controls the finisher 120 to carry out the NDB processing by the NDB unit 27 to the image receiving medium bundle to bind the image receiving medium bundle (Act 6). The control of the finisher 120 contains that the controller 20 controls the finisher 120 to execute the NDB processing, and the notification of the number of processed sheets of the print job for removal and the processing state of the job to the finisher 120. The finisher 120 receives the notification from the controller 20, and carries out the NDB processing to the image receiving medium bundle to bind the image receiving medium bundle.

The controller 20 discharges the image receiving medium bundle to the paper discharge tray 191 (Act 7).

If the print job for removal meets the conditions (Yes in Act 1), and if the number of processed sheets of the job is equal to or greater than the threshold value (No in Act 3), the controller 20 carries out the following processing. The controller 20 does not set the stapling processing (first processing) in the setting of the post processing of the print job for removing (ACT 8).

The controller 20 executes the job (Acts 9, 7). More specifically, the controller 20 sends the image receiving medium to the finisher 120 after the image is formed on the image receiving medium with the color material for removing by the second image forming section 16. The controller 20 carries out the processing corresponding to the number of processed sheets of the job (Act 9).

The controller 20 controls the finisher 120 to discharge each image receiving medium to the paper discharge tray 191 (Act 7). In Acts 9 and 7, the processing by the controller 20 for discharging the image receiving medium on which the image is formed to the paper discharge tray 191 without carrying out the stapling processing is the second processing that does not make a hole in the image receiving medium. In this case, the second processing section that carries out the second processing is a conveyance section containing the conveyance paths 13 and 23 and the conveyance rollers 14 and 24. The conveyance section conveys the image receiving medium on which the first image forming section 15 or the second image forming section 16 forms the image to the paper discharge tray 191.

Second Embodiment

Hereinafter, the processing of the job by the controller 20 is described with reference to FIG. 7. Hereinafter, the job executed by the controller 20 is the print job for removal.

If the print job for removal does not meet conditions (No in Act 11), the controller 20 executes the job without changing the setting of the print job for removal (Act 12). The conditions refer to that the automatic NDB is set and that a punch processing is set as the post processing of the print job for removal. The controller 20 refers to the conditions stored in the memory 202 to determine whether or not the print job for removal meets the conditions (Act 11).

Thus, the controller 20 carries out the punch processing (first processing) if the automatic NDB is not set and if the punch processing is set in the print job for removal.

If the print job for removal meets the conditions (Yes in Act 11), the controller 20 does not set the punch processing (first processing) in the setting of the post processing of the print job for removal (Act 13).

The controller 20 executes the job (Acts 14 and 15). More specifically, the controller 20 forms the image on the image receiving medium with the color material for removal (Act 14) and discharges the image receiving medium bundle to the paper discharge tray 191 through the finisher 120 (Act 15). In Acts 14 and 15, the processing by the controller 20 for discharging the image receiving medium on which the image is formed to the paper discharge tray 191 without any changes is the second processing. In this case, the second processing section that carries out the second processing under the control of the controller 20 is a conveyance section containing the conveyance paths 13 and 23 and the conveyance rollers 14 and 24.

Third Embodiment

Hereinafter, the job by the controller 28 of the finisher 120 is described with reference to FIG. 8. Hereinafter, the job executed by the apparatus main body 110 is the print job for removal. The controller 28 of the finisher 120 receives contents of the setting of the post processing of the job executed by the apparatus main body 110 and a processing state of the job from the apparatus main body 110.

If the print job for removal executed by the apparatus main body 110 does not meet conditions (No in Act 21), the controller 28 executes the post processing (first processing) of the job without changing the setting of the post processing of the print job for removal (Act 22). The conditions refer to that the automatic NDB is set and that the stapling processing is set as the post processing of the print job for removal. The controller 28 refers to the conditions stored in the memory 282 to determine whether or not the print job for removal meets the conditions (Act 21).

If the print job for removal executed by the apparatus main body 110 meets the conditions (Yes in Act 21) and the number of processed sheets of the job is smaller than a threshold value (Yes in Act 23), the controller 28 carries out the following processing. The controller 28 switches the stapling processing (first processing) to the NDB processing (second processing) in the setting of the post processing executed by the finisher 120 serving as the setting of the post processing of the print job for removal executed by the apparatus main body 110 (Act 24).

The controller 28 carries out the NDB processing to the image receiving medium bundle conveyed from the apparatus main body 110 (Act 25). The controller 28 discharges the image receiving medium bundle to the paper discharge tray 191 (Act 26).

If the print job for removal executed by the apparatus main body 110 meets the conditions (Yes in Act 21), and if the number of processed sheets of the job is equal to or greater than the threshold value (No in Act 23), the controller 28 does not set the stapling processing (first processing) in the setting of the post processing (ACT 27).

The controller 28 discharges the image receiving medium conveyed from the apparatus main body 110 to the paper discharge tray 191 (Act 26). In Act 26, the processing by the controller 28 for discharging the image receiving medium conveyed from the apparatus main body 110 to the paper discharge tray 191 without any changes is the second processing. In this case, the second processing section that carries out the second processing under the control of the controller 28 is a conveyance section containing the conveyance path 23 and the conveyance roller 24. The conveyance section conveys the image receiving medium conveyed from the apparatus main body 110 to the paper discharge tray 191.

Modification

In the print job executed by the controller 20 (or the controller 28), pages on which the images are formed with the color material for removing and pages on which the images are formed with the color material for non-removal may be mixed. Even in this case, the conditions on which the controller 20 switches the first processing (for example, the stapling processing) to the NDB processing are that the automatic NDB is set and that the first processing (for example, the stapling processing) is set as the setting of the post processing of the job.

The conditions in the first embodiment may be that the job is set to the automatic NDB and the punch processing is set as the setting of the post processing of the job.

As stated above in detail, according to the technology described herein, a post processing technology according to the processing to the image receiving medium can be supplied.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An image forming apparatus, comprising:

a first image forming section configured to use a color material for non-removal to permanently form an image on an image receiving medium;

a second image forming section configured to use a color material for removal to temporarily form an image on an image receiving medium;

a first processing section configured to carry out a first processing for making a hole in the image receiving medium on which the first image forming section or the second image forming section forms an image, and to comprise a puncher which makes a hole in an image receiving medium;

a second processing section configured to carry out a second processing which does not make a hole in the image receiving medium on which the first image forming section or the second image forming section forms an image;

a plurality of stacking sections which stack the image receiving medium;

a conveyance path configured to be bifurcated by a bifurcation arranged on a downstream side of the puncher in a conveyance direction, and to reach each of the stacking sections, and to convey an image receiving medium to any one of the plurality of stacking sections and switch a conveying route at the bifurcation; and a controller configured to carry out the second processing without carrying out the first processing to the image receiving medium on which the image is formed with the color material for removal at the time of executing a job in a case in which the job contains formation of the image with the color material for removal and carries out the first processing.

2. The image forming apparatus according to claim 1, wherein the first processing section comprises a plurality of staplers which drive a staple into an image receiving medium bundle to bind the image receiving medium bundle, each stapler is arranged corresponding to each of the stacking sections.

3. The image forming apparatus according to claim 2, wherein the second processing section comprises a no damage binding (NDB) processing section which carries out a NDB processing for binding the image receiving medium bundle through mounting a detachable clip to the image receiving medium bundle as the second processing.

4. The image forming apparatus according to claim 3, wherein the second processing section comprises a conveyance section for conveying the image receiving medium on which the second image forming section forms the image to the stacking section, and the conveyance section comprises a conveyance roller and the conveyance path, and the controller carries out the second processing for conveying the image receiving medium on which the second image forming section forms an image to one of the plurality of stacking sections by the conveyance section without carrying out the NDB processing at the time of executing the job in a case in which a number of processed sheets is equal to or greater than a threshold value in a setting of the job.

5. The image forming apparatus according to claim 1, wherein the color material for removal is decolored through being heated.

6. The image forming apparatus according to claim 1, wherein the color material for removal is decolored through irradiation, a blade, or chemical means.

7. A method for executing a job by an image forming apparatus that can carry out formation of an image on an image receiving medium using a color material for non-removal and formation of an image on an image receiving medium using a color material for removal, and also can carry out a first processing for making a hole and a second processing that does not make a hole in the image receiving medium on which the image is formed, the first processing comprising binding an image receiving medium bundle through driving a staple into the image receiving medium bundle by using a puncher, comprising:

executing the second processing without carrying out the first processing to the image receiving medium on which the image is formed with the color material for removal at the time of executing the job in a case in which the job contains formation of the image with the color material for removal and carries out the first processing;

conveying an image receiving medium to any one of stacking sections by using a conveyance path which is bifurcated by a bifurcation arranged on a downstream side of the puncher in a conveyance direction and reaches each of the stacking sections; and switching a conveying route at the bifurcation.

8. The method according to claim 7, further comprising binding an image receiving medium bundle through driving a staple into the image receiving medium bundle by using a stapler which is arranged corresponding to each of the stacking sections in the first processing.

9. The method according to claim 8, further comprising executing the second processing for conveying the image receiving medium on which an image is formed with the color material for removing to one of the plurality of stacking sections.

10. The method according to claim 7, further comprising binding an image receiving medium bundle through driving a staple into the image receiving medium bundle by using a stapler which is arranged corresponding to each the stacking section in the first processing, and executing a no damage binding (NDB) processing for binding the image receiving medium bundle through mounting a detachable clip to the image receiving medium bundle as the second processing.

11. The method according to claim 10, further comprising executing the second processing for conveying the image receiving medium on which an image is formed with the color material for removal to one of the plurality of stacking sections without carrying out the NDB processing at the time of executing the job in a case in which a number of processed sheets is equal to or greater than a threshold value in a setting of the job.

12. A processing apparatus for carrying out a processing to an image receiving medium on which an image forming apparatus that can carry out formation of an image on an image receiving medium using a color material for non-removal and formation of an image on an image receiving medium using a color material for removal forms an image, comprising:

a first processing section configured to carry out a first processing for making a hole in the image receiving medium to the image receiving medium on which the image forming apparatus forms an image, and to comprise a puncher which makes a hole in an image receiving medium;

a second processing section configured to carry out a second processing which does not make a hole in the image receiving medium to the image receiving medium on which the image forming apparatus forms an image;

a plurality of stacking sections which stack the image receiving medium;

a conveyance path configured to be bifurcated by a bifurcation arranged on a downstream side of the puncher in a conveyance direction, and to reach each of the stacking sections, and to convey an image receiving medium to any one of the plurality of stacking sections and switch a conveying route at the bifurcation; and a controller configured to carry out the second processing without carrying out the first processing to the image receiving medium on which the image forming apparatus forms an image at the time of executing a job by the image forming apparatus and the processing apparatus in a case in which the job executed by the image forming apparatus contains formation of the image with the color material for removal and carries out the first processing.

13. The processing apparatus according to claim 12, wherein the first processing section comprises a plurality of staplers which drive a staple into an image receiving medium bundle to bind the image receiving medium bundle, each stapler is arranged corresponding to each of the stacking sections.

14. The processing apparatus according to claim 13, wherein the second processing section comprises a no damage binding (NDB) processing section which carries out an NDB processing as the second processing for binding the image receiving medium bundle through mounting a detachable clip to the image receiving medium bundle.

15. The processing apparatus according to claim 14, wherein the second processing section comprises a conveyance section for conveying the image receiving medium on which the second image forming section forms the image to one of the plurality of stacking sections, and the conveyance section comprises a conveyance roller and the conveyance path, and the controller carries out the second processing for conveying the image receiving medium on which the second image forming section forms an image to one of the plurality of stacking sections by the conveyance section without carrying out the NDB processing at the time of executing the job in a case in which a number of processed sheets is equal to or greater than a threshold value in a setting of the job.

* * * * *